US008160869B2

(12) United States Patent
Lee et al.

(10) Patent No.: US 8,160,869 B2
(45) Date of Patent: Apr. 17, 2012

(54) METHOD AND APPARATUS FOR ENCODING CONTINUATION SINUSOID SIGNAL INFORMATION OF AUDIO SIGNAL AND METHOD AND APPARATUS FOR DECODING SAME

(75) Inventors: Nam-suk Lee, Suwon-si (KR); Geon-hyoung Lee, Hwanseong-si (KR); Jae-one Oh, Yongin-si (KR); Jong-hoon Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 988 days.

(21) Appl. No.: 12/132,299

(22) Filed: Jun. 3, 2008

(65) Prior Publication Data

US 2009/0055197 A1 Feb. 26, 2009

(30) Foreign Application Priority Data

Aug. 20, 2007 (KR) ..... 10-2007-0083451

(51) Int. Cl.
*G10L 19/08* (2006.01)

(52) U.S. Cl. ..... 704/219; 704/500; 704/200.1; 704/229; 704/243; 375/240.13; 375/240.16

(58) Field of Classification Search ..... 704/219, 704/500–504, 240.16, 243, 200.1, 229, 230; 375/240.13, 240.16

See application file for complete search history.

(56) References Cited

U.S. PATENT DOCUMENTS

| | | | | |
|---|---|---|---|---|
| 6,266,644 | B1 | 7/2001 | Levine | |
| 7,725,310 | B2 * | 5/2010 | Den Brinker et al. | 704/219 |
| 7,979,271 | B2 * | 7/2011 | Bessette | 704/219 |
| 2003/0083886 | A1 * | 5/2003 | Den Brinker et al. | 704/500 |
| 2006/0036431 | A1 * | 2/2006 | Den Brinker et al. | 704/206 |
| 2007/0027678 | A1 * | 2/2007 | Hotho et al. | 704/203 |
| 2007/0112560 | A1 * | 5/2007 | Gerrits et al. | 704/205 |
| 2007/0282603 | A1 * | 12/2007 | Bessette | 704/219 |
| 2008/0294445 | A1 * | 11/2008 | Lee et al. | 704/500 |

FOREIGN PATENT DOCUMENTS

| | | | |
|---|---|---|---|
| WO | 2005/008628 | A1 | 1/2005 |
| WO | 2005/036529 | A1 | 4/2005 |

* cited by examiner

*Primary Examiner* — Vijay B Chawan
(74) *Attorney, Agent, or Firm* — Sughrue Mion, PLLC

(57) ABSTRACT

Provided are a method and apparatus for encoding an audio signal and a method and apparatus for decoding an audio signal. The method includes performing sinusoidal analysis on an audio signal in order to extract a sinusoidal signal of a current frame, determining continuation sinusoidal signal information indicating a number of continuation sinusoidal signals of next frames, which continue from the sinusoidal signal of the current frame, by performing sinusoidal tracking on the extracted sinusoidal signal of the current frame, and encoding the determined continuation sinusoidal signal information by using different Huffman tables according to index information of the current frame, thereby allowing efficient encoding with a low bitrate.

15 Claims, 7 Drawing Sheets

FIG. 1 <RELATED ART>

FIG. 6

| sf = 0 | | | | | | | | | | |
|---|---|---|---|---|---|---|---|---|---|---|
| s_cont | 0 | 1 | 2 | 3 | 4 | 5 | 6 | 7 | 8 | 9 |
| bit | 1000 | 0100 | 101 | 011 | 001 | 1001 | 0101 | 0001 | 0000 | 11 |

| sf = 1 | | | | | | | | | |
|---|---|---|---|---|---|---|---|---|---|
| s_cont | 0 | 1 | 2 | 3 | 4 | 5 | 6 | 7 | 8 |
| bit | 1000 | 0100 | 101 | 011 | 001 | 1001 | 0101 | 0001 | 11 |

| sf = 2 | | | | | | | | |
|---|---|---|---|---|---|---|---|---|
| s_cont | 0 | 1 | 2 | 3 | 4 | 5 | 6 | 7 |
| bit | 1000 | 0100 | 101 | 011 | 001 | 1001 | 0101 | 11 |

| sf = 3 | | | | | | | |
|---|---|---|---|---|---|---|---|
| s_cont | 0 | 1 | 2 | 3 | 4 | 5 | 6 |
| bit | 1000 | 0100 | 101 | 011 | 001 | 1001 | 11 |

| sf = 4 | | | | | | |
|---|---|---|---|---|---|---|
| s_cont | 0 | 1 | 2 | 3 | 4 | 5 |
| bit | 1000 | 0100 | 101 | 011 | 001 | 11 |

| sf = 5 | | | | | |
|---|---|---|---|---|---|
| s_cont | 0 | 1 | 2 | 3 | 4 |
| bit | 011 | 010 | 110 | 000 | 1 |

| sf = 6 | | | | |
|---|---|---|---|---|
| s_cont | 0 | 1 | 2 | 3 |
| bit | 000 | 001 | 01 | 1 |

| sf = 7 | | | |
|---|---|---|---|
| s_cont | 0 | 1 | 2 |
| bit | 01 | 00 | 1 |

FIG. 7

| File Name | Gain (%) | |
|---|---|---|
| | Gain for s_cont | Gain for entire bitrate |
| ssc_n4.mp4 | 14.52 | 0.84 |
| ssc_ps1.mp4 | 13.31 | 0.91 |
| ssc_ps1_mono.mp4 | 13.31 | 0.93 |
| ssc_ps2.mp4 | 12.66 | 0.77 |
| ssc_ps2_mono.mp4 | 12.66 | 0.84 |
| ssc_ps3.mp4 | 13.11 | 0.86 |
| ssc_ps3_mono.mp4 | 13.11 | 0.90 |
| ssc_ps4.mp4 | 12.83 | 0.80 |
| ssc_ps4_mono.mp4 | 12.83 | 0.86 |
| ssc_ps5.mp4 | 12.67 | 0.76 |
| ssc_ps5_mono.mp4 | 12.67 | 0.84 |
| ssc_ps6.mp4 | 11.58 | 0.54 |
| ssc_ps6_mono.mp4 | 11.58 | 0.70 |
| ssc_ps7.mp4 | 14.18 | 0.97 |
| ssc_ps7_mono.mp4 | 14.18 | 1.02 |
| ssc_s1.mp4 | 0.59 | 0.04 |
| ssc_s2.mp4 | 0.00 | 0.00 |
| ssc_s3.mp4 | 2.20 | 0.15 |
| ssc_t1.mp4 | 13.49 | 1.26 |
| ssc_t2.mp4 | 0.00 | 0.00 |
| average | 11.75 | 0.78 |

METHOD AND APPARATUS FOR ENCODING CONTINUATION SINUSOID SIGNAL INFORMATION OF AUDIO SIGNAL AND METHOD AND APPARATUS FOR DECODING SAME

CROSS-REFERENCE TO RELATED PATENT APPLICATION

This application claims the benefit of Korean Patent Application No. 10-2007-0083451, filed on Aug. 20, 2007, in the Korean Intellectual Property Office, the disclosure of which is incorporated herein in its entirety by reference.

BACKGROUND OF THE INVENTION

1. Field of the Invention

Methods and apparatuses consistent with the present invention relate to encoding and decoding of an audio signal, and more particularly, to encoding an audio signal, in which continuation sinusoid signal information indicating the number of sub frames where continuation sinusoid signals exist is encoded in different ways according to index information of a frame, and decoding an audio signal.

2. Description of the Related Art

An audio encoding method is applied to parametric coding. Parametric coding expresses an audio signal by using a particular parameter. Parametric coding is used in the Moving Picture Experts Group (MPEG)-4 standard.

FIG. 1 is a diagram for explaining parametric coding. In parametric coding, an input signal is analyzed and parameterized. Referring to FIG. 1, an input audio signal is appropriately filtered by audio reading and filtering 110. Parameters for audio components in each domain are extracted by performing three types of analysis, i.e., transient analysis 120, sinusoidal analysis 130, and noise analysis 140.

The transient analysis deals with a dynamic audio change. The sinusoidal analysis deals with a deterministic audio change. The noise analysis deals with a stochastic or non-deterministic audio change.

The extracted parameters are formatted into a bitstream by performing bitstream formatting 150.

SUMMARY OF THE INVENTION

The present invention provides a method of encoding an audio signal using parametric coding for efficient encoding capable of lowering a bitrate required for coding.

The present invention also provides a method and apparatus for encoding an audio signal, in which continuation sinusoidal signal information indicating the number of subsequent frames where continuation sinusoidal signals of a partial sinusoidal signal extracted by sinusoidal analysis, which continue from a sinusoidal signal of a previous frame, exist is encoded in different ways according to index information of each of the frames, and a method and apparatus for decoding an audio signal of a bitstream encoded using the method.

According to one aspect of the present invention, there is provided a method of encoding an audio signal. The method includes performing sinusoidal analysis on an input audio signal in order to extract a sinusoidal signal of a current frame, determining continuation sinusoidal signal information indicating the number of continuation sinusoidal signals of a next frame, which continue from the sinusoidal signal of the current frame, by performing sinusoidal tracking on the extracted sinusoidal signal of the current frame, and encoding the determined continuation sinusoidal signal information by using a plurality of different Huffman tables according to index information of the current frame.

The continuation sinusoidal signal information may indicate the number of subsequent frames where the continuation sinusoidal signals continuing from the sinusoidal signal of the current frame exist.

The determination of the continuation sinusoidal signal information may include determining a range of the continuation sinusoidal signal information according to the index information of the current frame in a super frame including the current frame.

The determination of the range of the continuation sinusoidal signal information may include determining the range of the continuation sinusoidal signal information in the current frame based on index information of a frame to be encoded together with the continuation sinusoidal signal information for random access in a next super frame following the super frame.

The encoding of the determined continuation sinusoidal signal information by using the plurality of different Huffman tables may include using a Huffman table corresponding to the determined range of the continuation sinusoidal signal information of the current frame from among a plurality of Huffman tables generated according to ranges of continuation sinusoidal signal information.

The number of the plurality of Huffman tables may be the same as the number of frames included in the super frame.

According to another aspect of the present invention, there is provided an apparatus for encoding an audio signal. The apparatus includes a sinusoidal signal analysis unit performing sinusoidal analysis on an input audio signal in order to extract a sinusoidal signal of a current frame, a continuation sinusoidal signal information determination unit determining continuation sinusoidal signal information indicating the number of continuation sinusoidal signals of a next frame, which continue from the sinusoidal signal of the current frame, by performing sinusoidal tracking on the extracted sinusoidal signal of the current frame, and an encoding unit encoding the determined continuation sinusoidal signal information by using a plurality of different Huffman tables according to index information of the current frame.

The continuation sinusoidal signal information may indicate the number of subsequent frames where the continuation sinusoidal signals continuing from the sinusoidal signal of the current frame exist.

The continuation sinusoidal signal information determination unit may include a continuation sinusoidal signal information calculation unit which determines a range of the continuation sinusoidal signal information according to the index information of the current frame in a super frame including the current frame.

The continuation sinusoidal signal information calculation unit may determine the range of the continuation sinusoidal signal information in the current frame based on index information of a frame to be encoded together with the continuation sinusoidal signal information for random access in a next super frame following the super frame.

The encoding unit may use a Huffman table corresponding to the determined range of the continuation sinusoidal signal information of the current frame from among a plurality of Huffman tables generated according to ranges of the continuation sinusoidal signal information.

The number of the plurality of Huffman tables may be the same as the number of frames included in the super frame.

According to another aspect of the present invention, there is provided a method of decoding an audio signal input as a bitstream. The method includes determining whether the input bitstream includes continuation sinusoidal signal information indicating the number of continuation sinusoidal signals of a next frame, which continue from a sinusoidal signal of a current frame and decoding the continuation sinusoidal signal information by using a plurality of different Huffman tables according to index information of the current frame if the bitstream includes the continuation sinusoidal signal information.

According to another aspect of the present invention, there is provided an apparatus for decoding an audio signal input as a bitstream. The apparatus includes a continuation sinusoidal signal information determination unit determining whether the input bitstream includes continuation sinusoidal signal information indicating the number of continuation sinusoidal signals of a next frame, which continue from a sinusoidal signal of a current frame and a decoding unit decoding the continuation sinusoidal signal information by using a plurality of different Huffman tables according to index information of the current frame if the bitstream includes the continuation sinusoidal signal information.

According to another aspect of the present invention, there is provided a computer-readable recording medium having recorded thereon a program for executing the method of encoding an audio signal.

BRIEF DESCRIPTION OF THE DRAWINGS

The above and other aspects of the present invention will become more apparent by describing in detail exemplary embodiments thereof with reference to the attached drawings in which:

FIG. 6 illustrates different Huffman tables based on frame indices according to an exemplary embodiment of the present invention;

FIG. 7 illustrates a table showing a gain of a bitrate using a method of encoding an audio signal according to an exemplary embodiment of the present invention when compared to a gain of a bitrate using the prior art;

DETAILED DESCRIPTION OF EXEMPLARY EMBODIMENTS OF THE INVENTION

Figure 1:
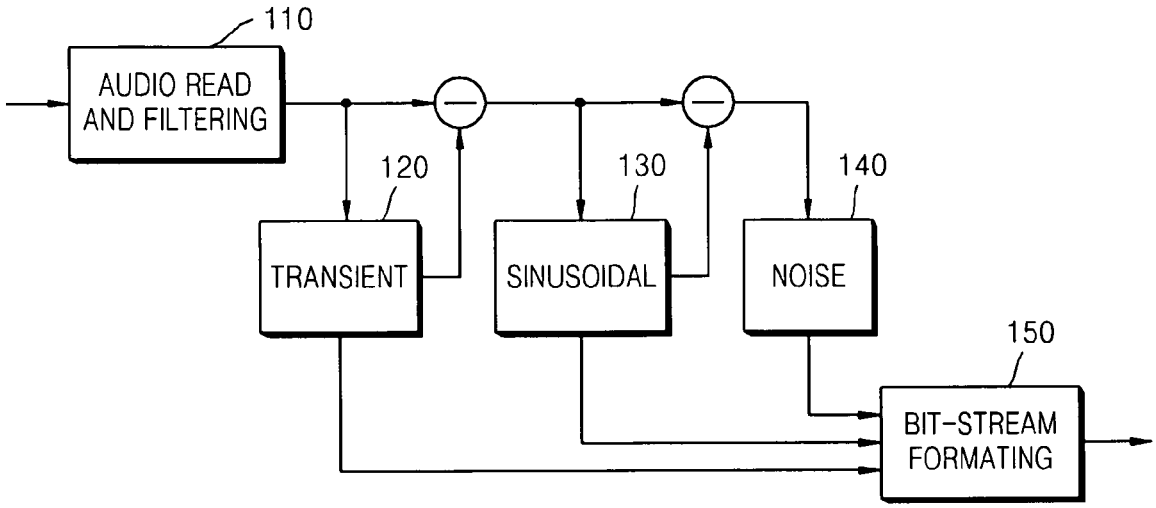
FIG. 1 is a diagram for explaining parametric coding.

Hereinafter, exemplary embodiments of the present invention will be described in detail with reference to the accompanying drawings. It should be noted that like reference numerals refer to like elements illustrated in one or more of the drawings. In the following description of the present invention, detailed description of known functions and configurations incorporated herein will be omitted for conciseness and clarity.

Figure 2:
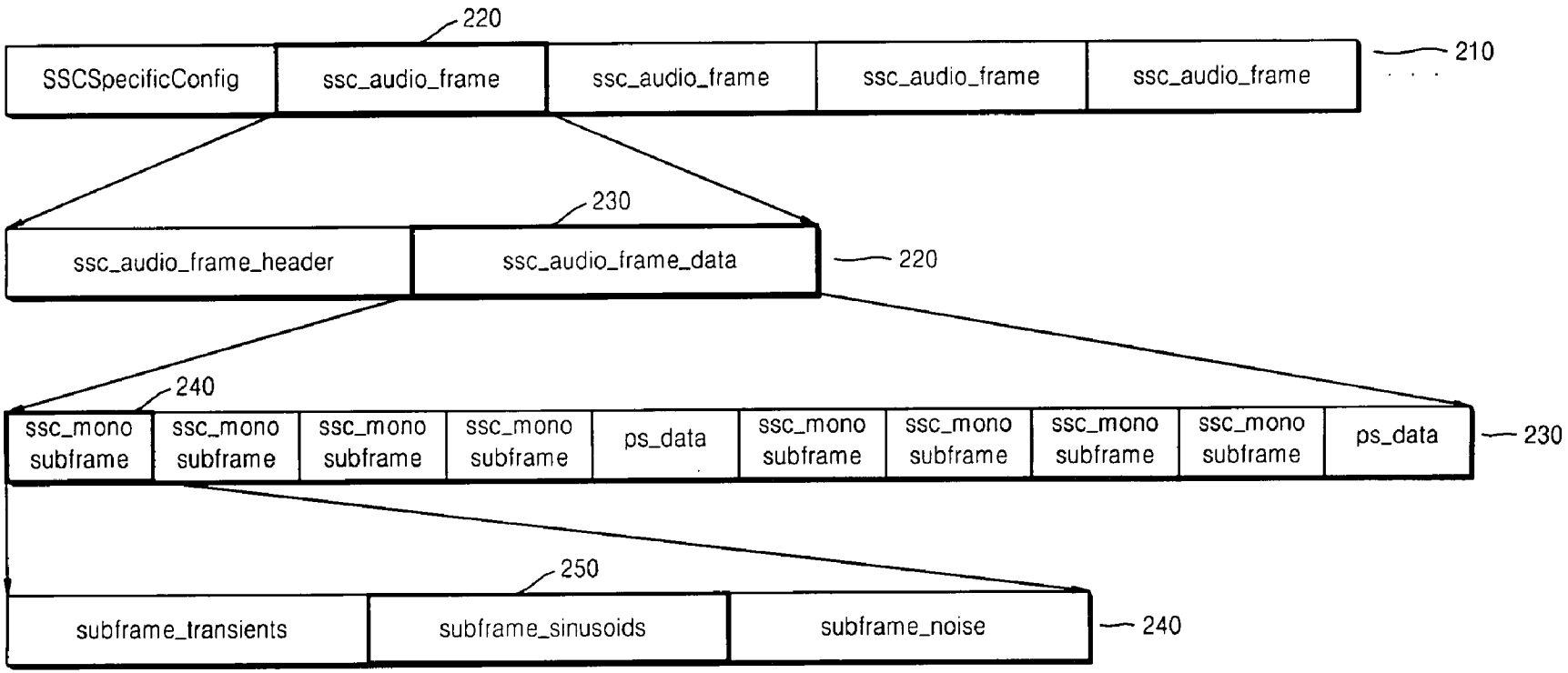
FIG. 2 illustrates the data structure of a sinusoidal signal coded (SSC) bitstream.

FIG. 2 illustrates the data structure of a sinusoidal signal coded (SSC) bitstream.

Referring to FIG. 2, the data structure of a bitstream used in sinusoidal signal coding (SSC) is a nested data structure.

A first data format 210 includes a plurality of audio frames (ssc_audio_frame) 220. The audio frames 220 can be divided into an audio frame header (ssc_audio_frame_header) and audio frame data (ssc_audio_frame_data) 230. When the audio frame data 230 is a super frame, the audio frame data 230 includes a plurality of sub frames (ssc_mono subframe) 240. The relationship between the super frame 230 and the sub frames 240 is not fixed and the super frame 230 and the sub frames 240 are relative concepts that correspond to each other. Each of the sub frames 240 includes a transient field (subframe_transients), a sinusoidal field (subframe_sinusoids) 250, and a noise field (subframe_noise). From among the transient field, the sinusoidal field 250, and the noise field, the sinusoidal field 250 including sinusoidal components contains the most important information and requires the largest amount of bits for encoding.

Continuation sinusoidal signal information, i.e., data indicating the number of subsequent frames where continuation sinusoidal signals continuing from a sinusoidal signal of a previous sub frame exist, is included in the sinusoidal field 250 and is generally indicated by a variable s_cont in SSC.

Figure 3:
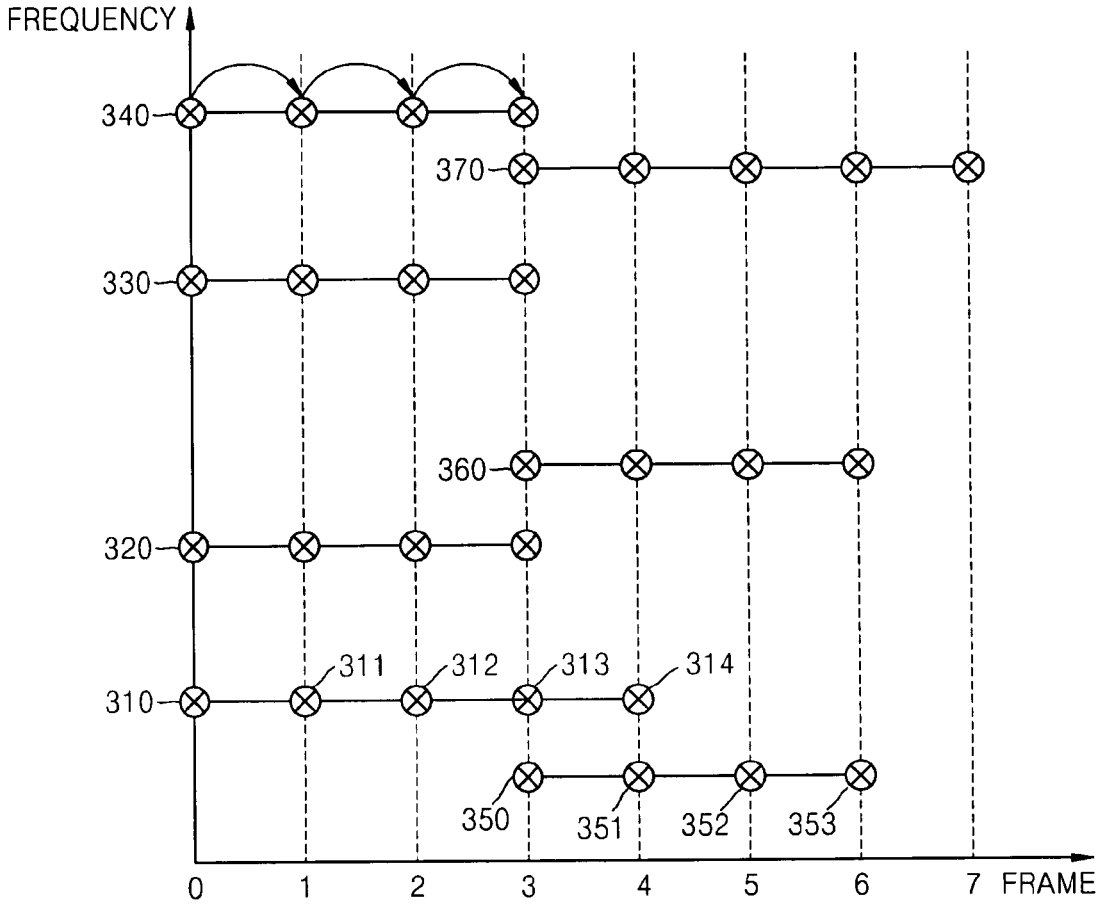
FIG. 3 illustrates the relationship between tracked sinusoidal signals.

FIG. 3 illustrates the relationship between tracked sinusoidal signals.

In sinusoidal coding, after sinusoidal analysis is performed, as illustrated in FIG. 1, a sinusoidal signal is tracked for adaptive differential pulse code modulation (ADPCM) coding or differential pulse code modulation (DPCM) coding with respect to the sinusoidal signal.

Tracking is a process of searching for sinusoidal signals continuing from each other from among sinusoidal signals included in successive frames and setting a correspondence relationship between the found sinusoidal signals. In FIG. 3, points marked with ⓧ indicate sinusoidal components that exist on a frequency axis (or a y axis) and lines connecting the points indicate tracking results of sinusoidal signals of each frame.

A sinusoidal signal of a current frame, which cannot be tracked from sinusoidal signals of a previous frame, is referred to as a birth sinusoidal signal or a birth partial signal. "Birth" means that a sinusoidal signal does not continue from a sinusoidal signal of the previous frame, but is newly generated in the current frame. In FIG. 3, birth sinusoidal signals are indicated by reference numerals 350, 360, and 370. It is determined whether sinusoidal signals 310 through 340 are birth sinusoidal signals based on relationship of the sinusoidal signals 310 through 340 with the previous frame. Difference-coding using sinusoidal signals of the previous frame cannot be performed on a birth sinusoidal signal and absolute-coding can be performed on the birth sinusoidal signal. Thus, the birth sinusoidal signal requires a large number of bits for encoding.

On the other hand, a sinusoidal component of the current frame, which can be tracked from the sinusoidal signals of the previous frame, is referred to as a continuation sinusoidal signal or a continuation partial signal. For example, sinusoidal signals 351, 352, and 353 are continuation sinusoidal signals continuing from the birth sinusoidal signal 350. Since difference-coding can be performed on continuation sinusoidal signals using sinusoidal signals of the previous frame, which correspond to the continuation sinusoidal signals, the continuation sinusoidal signals can be efficiently coded. Difference-coding is performed because the number of bits can be reduced using a correlation between parameters (frequency, amplitude, and phase) of sinusoidal components when compared to a case with absolute-coding.

Continuation of sinusoidal components from each other means that they have correlation therebetween. In this case, the sinusoidal components share correlated information and thus one of the sinusoidal components can be predicted by using another one, thereby allowing efficient data coding.

Continuation of sinusoidal components from each other can be determined using a difference between the frequencies of the sinusoidal components or both the difference and a ratio of the amplitudes of the sinusoidal components. When the difference between the frequencies of the sinusoidal components is used, it is determined whether the difference is less than a predetermined value and the sinusoidal components are determined to have correlation when the difference is less than the predetermined value. For example, when the difference is less than 0.4 equivalent rectangular bandwidth rate (ERB), the sinusoidal components are determined to continue from each other. When both the difference and the ratio are used, the sinusoidal components may be determined to continue from each other if the difference is less than the predetermined value and the ratio is less than a predetermined value. For example, if the difference is less than 0.4 ERB and the amplitude of a current sinusoidal component is greater than ⅓ times and less than 3 times the amplitude of a previous sinusoidal component, the current sinusoidal component and the previous sinusoidal component may be determined to continue from each other.

In particular, a sinusoidal signal of a continuation sinusoidal signal, which is not connected to a sinusoidal signal of a next frame and disappears, is referred to as a death sinusoidal signal or a death partial signal. In FIG. 3, death sinusoidal signals are indicated by reference numerals 353 and 314.

The variable s_cont indicates the number of sinusoidal signals continuing from the current sinusoidal signal from among sinusoidal signals of next frames. In other words, the variable s_cont indicates the number of subsequent frames where continuation sinusoidal signals exist. In FIG. 3, in the case of the sinusoidal signal 350 included in a frame having a frame index 3, the sinusoidal signals 351, 352, and 353 continue from the sinusoidal signal 350 of the current frame 3 from among sinusoidal signals of next frames 4, 5, and 6. Thus, the variable s_cont of the sinusoidal signal 350 is 3.

In the case of the sinusoidal signal 310 included in a frame 0, sinusoidal signals 311, 312, 313, and 314 continue from the sinusoidal signal 310 of the current frame 0 from among sinusoidal signals of next frames. Thus, the variable s_cont of the sinusoidal signal 310 is 4.

The variable s_cont is transmitted for each first sub frame for random access in a next frame and is transmitted each time a birth sinusoidal signal is generated. Referring to FIG. 3, the variable s_cont is transmitted in the first frame 0 having a frame index 0 and is transmitted in the frame 3 where the birth sinusoidal signal is generated.

Thus, the variable s_cont is not necessarily an infinitely large value because it is transmitted in the first sub frame for each frame. In other words, the variable s_cont is to be transmitted in the first sub frame of a next frame even when the number of subsequent frames where continuation sinusoidal signals exist is 20. Thus, it is not necessary to transmit a large value of 20. As a result, the variable s_cont is one of values 0 through 9 because a frame used in SSC is composed of 8 sub frames and two sub frames have to be first sent for a difference s_delta_cont_freq_pha between the frequency or phase of a current sinusoidal signal and the frequency or phase of a previous sinusoidal signal of a previous frame. In other words, since the number of sub frames of a frame is 8 and two of the sub frames have to be first transmitted, the variable s_cont may be one of 10 values from 0 to 9.

Moreover, the range of the variable s_cont to be expressed in a sub frame of a frame may change. More specifically, when the variable s_cont is transmitted in each of 8 sub frames, the range of the variable s_cont may vary from [0,2] to [0,9] according to the position of each of the sub frames, i.e., a sub frame index (0-7) of each of the sub frames. Based on such a principle, the present invention suggests a way to encode the variable s_cont with a smaller number of bits.

Figure 4:
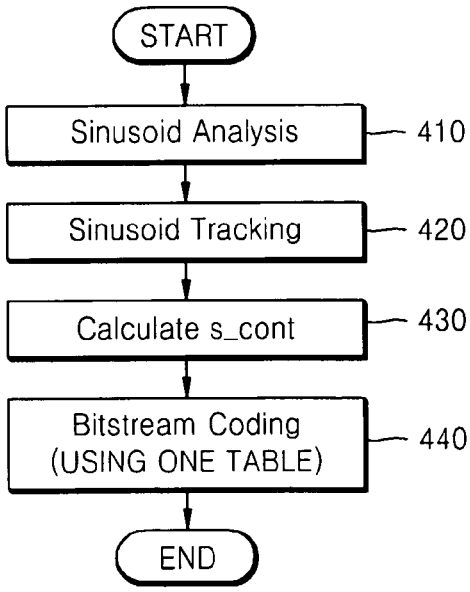
FIG. 4 is a flowchart illustrating a method of encoding continuation sinusoidal signal information according to the related art.

FIG. 4 is a flowchart illustrating a method of encoding continuation sinusoidal signal information according to the related art.

Referring to FIG. 4, upon input of an audio signal, sinusoidal components of a current frame are extracted by sinusoidal analysis in operation 410. In operation 420, tracking is performed on the extracted sinusoidal components by searching for a sinusoidal component that is similar to that of a previous frame from among the sinusoidal components of the current frame and connecting the found sinusoidal component with the sinusoidal component of the previous frame (or the previous sinusoidal component). As mentioned previously, the sinusoidal component continuing from the previous sinusoidal component is called the continuation sinusoidal component.

Since the number of subsequent frames where the continuation sinusoidal component exists can be known by performing tracking, continuation sinusoidal signal information indicating the number of subsequent frames where the continuation sinusoidal component exists, i.e., the variable s_cont, is calculated in operation 430. In operation 440, parameters of the sinusoidal signal are coded into a bitstream, together with the variable s_cont, by using a Huffman table.

Figure 5:
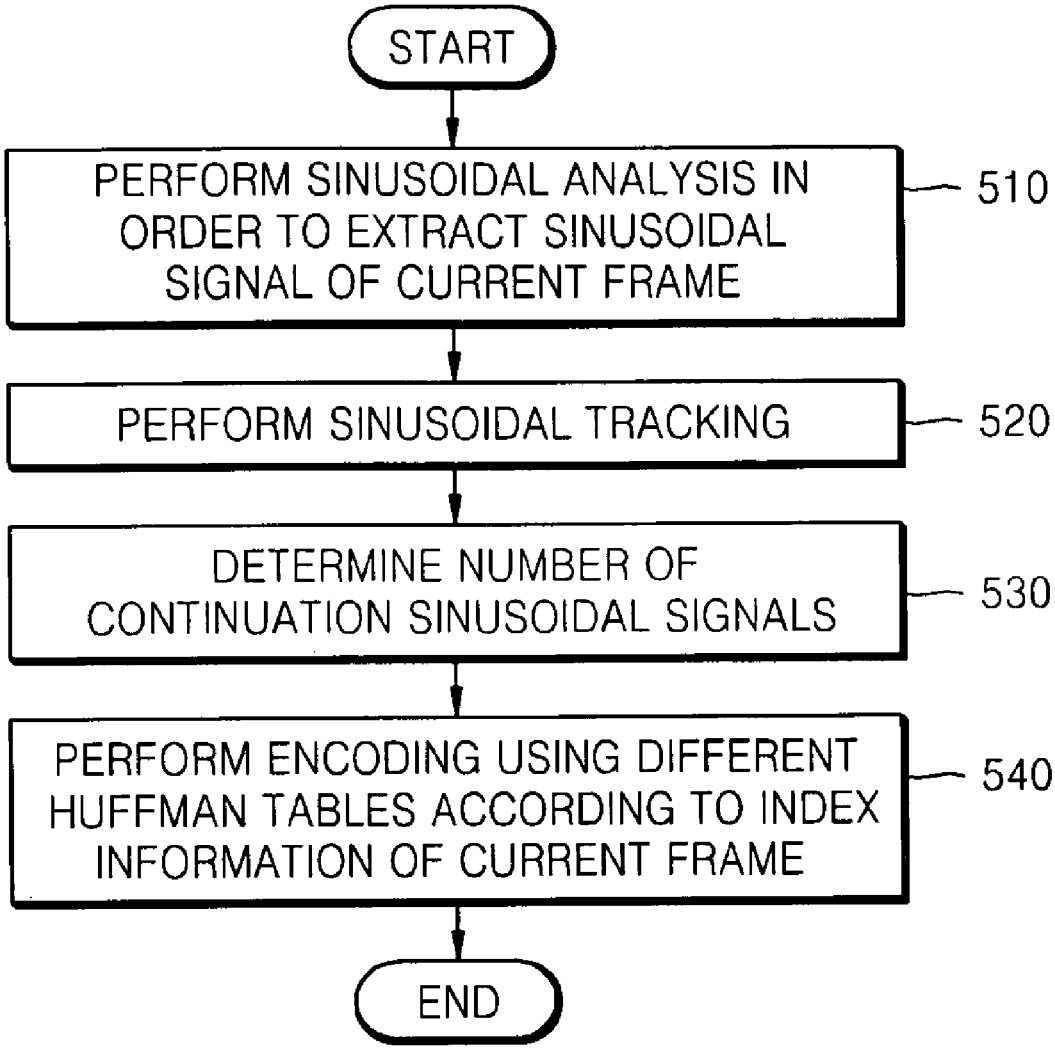
FIG. 5 is a flowchart illustrating a method of encoding an audio signal according to an exemplary embodiment of the present invention.

FIG. 5 is a flowchart illustrating a method of encoding an audio signal according to an exemplary embodiment of the present invention.

Referring to FIG. 5, sinusoidal analysis is performed on an input audio signal in order to extract a sinusoidal signal of a current frame in operation 510. Sinusoidal tracking is performed on the extracted sinusoidal signal of the current frame in operation 520. Continuation sinusoidal signal information indicating the number of continuation sinusoidal signals of a next frame, which continue from the sinusoidal signal of the current frame, is determined in operation 530. The continuation sinusoidal signal information is encoded by using different Huffman tables according to index information of the current frame in operation 540.

During the determination of the continuation sinusoidal signal information, the range of the continuation sinusoidal signal information may also be determined according to the index information of the current frame in a super frame including the current frame.

More specifically, sinusoidal analysis is performed on an input audio signal in order to extract a sinusoidal signal of the current frame in operation 510.

In operation 520, tracking is performed on the extracted sinusoidal signal in order to search for a sinusoidal signal of a previous frame, which is similar to the sinusoidal signal of the current frame.

In operation 530, the number of continuation sinusoidal signals continuing from the sinusoidal signal of the previous frame is determined. This operation is similar to the determination of the number of subsequent frames where the continuation sinusoidal signals exist. However, the number of continuation sinusoidal signals, i.e., the variable s_cont has a fixed range. Thus, the variable s_cont has one of values 0 to 9. This is because the number of sub frames of a frame is eight in SSC and two of the sub frames have to be transmitted first as mentioned above. Moreover, the range of the variable s_cont in each sub frame is one of eight ranges [0,9], [0,8], through to [0,3], [0,2] according to a frame index (0-7) of the current frame.

Finally, parameters of the sinusoidal signal are coded together with the variable s_cont. At this time, Huffman tables optimized for the eight range cases according to the frame index of the current frame may be used. In other words, different variable length coding (VLC) tables according to frame indices of a frame are used. The Huffman tables will be described in detail with reference to FIG. 6.

In other words, instead of a single table generated on the assumption that the variable s_cont has a range of [0,9], eight Huffman tables generated for the eight ranges [0,9], [0,8], through to [0,3], [0,2] on the assumption that the variable s_cont has different values according to the 8 ranges [0,9], [0,8], through to [0,3], [0,2], are used for coding.

FIG. 6 illustrates different Huffman tables based on frame indices according to an exemplary embodiment of the present invention.

Referring to FIG. 6, eight Huffman tables sf=0, sf=1, through to sf=7 corresponding to the number of sub frames included in a super frame according to frame indices 0-7 of a sub frame are illustrated.

For sf=0, a sub frame index of a sub frame is 0 and thus the variable s_cont is transmitted in the first sub frame. At this time, the range of the variable s_cont is [0,9]. Thus, the variable s_cont is coded into a corresponding bitstream of the Huffman table.

For sf=7, a sub frame index of a sub frame is 7 and thus the variable s_cont is transmitted in the last sub frame. At this time, the range of the variable s_cont is [0,2]. Thus, the variable s_cont can be coded with even less bits than the case with sf=0.

Therefore, more efficient coding can be performed using a Huffman table corresponding to the range of the variable s_cont according to a sub frame index of a sub frame from among a plurality of Huffman tables.

FIG. 7 illustrates a table showing a gain of a bitrate using a method of encoding an audio signal according to an exemplary embodiment of the present invention when compared to a gain of a bitrate using the related art.

A gain indicates a rate of bitrate reduction after coding. For example, a gain of 14.52% means a bitrate reduction of 14.52%.

In order to obtain such a result, a bitrate corresponding to encoding of the variable s_cont using a single Huffman table according to the related art is first measured. Let this bitrate be bit_rate_1. The Huffman table used at this time is the same as the Huffman table corresponding to sf=0 in FIG. 6.

Next, a bitrate corresponding to encoding of the variable s_cont using a plurality of Huffman tables illustrated in FIG. 6 according to the present invention is measured. Let the bitrate be bit_rate_2.

A gain of the table illustrated in FIG. 7 is obtained as follows:

$$\text{Gain}(\%)=(\text{bit_rate_1}-\text{bit_rate_2})/(\text{bit_rate_1})*100\ (\%) \quad (1)$$

Referring to FIG. 7, comparison experiment is conducted using 20 test audio files.

In the table illustrated in FIG. 7, the first item "Gain for s_cont" means a bitrate reduction rate when only s_cont is encoded. It can be seen from FIG. 7 that an average bitrate reduction of 11.75% is obtained when compared to the prior art.

The second item "Gain for entire bitrate" means a bitrate reduction rate when s_cont and a sinusoidal signal including s_cont are encoded. As can be seen from FIG. 7, a bitrate reduction of 0.78% is obtained when compared to the prior art. Since the rate of bits of s_cont in a sinusoidal signal to be encoded is low, a bitrate reduction is also small.

Figure 8:
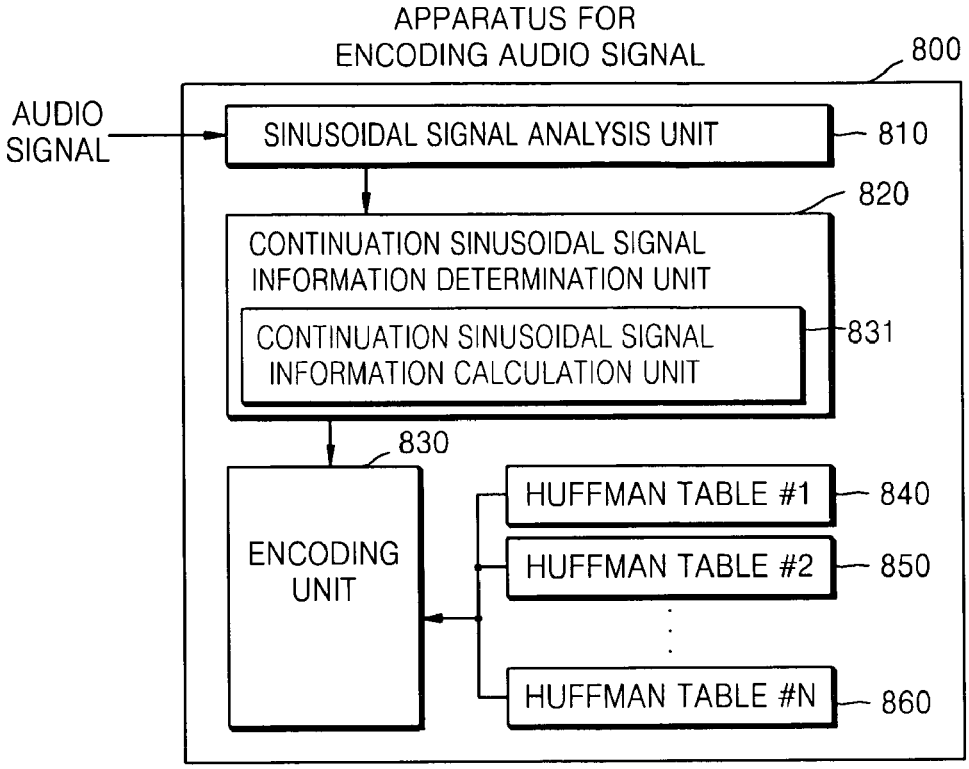
FIG. 8 is a block diagram of an apparatus for encoding an audio signal according to an exemplary embodiment of the present invention.

FIG. 8 is a block diagram of an apparatus 800 for encoding an audio signal according to an exemplary embodiment of the present invention.

Referring to FIG. 8, the apparatus 800 includes a sinusoidal signal analysis unit 810, a continuation sinusoidal signal information determination unit 820, and an encoding unit 830. The sinusoidal signal analysis unit 810 performs sinusoidal analysis on an input audio signal in order to extract a sinusoidal signal of a current frame. The continuation sinusoidal signal information determination unit 820 determines continuation sinusoidal signal information indicating the number of continuation sinusoidal signals of a next frame, which continue from the sinusoidal signal of the current frame, by performing sinusoidal tracking on the extracted sinusoidal signal of the current frame. The encoding unit 830 encodes the determined continuation sinusoidal signal information using different Huffman tables 840 through 860 according to index information of the current frame.

The continuation sinusoidal signal information determination unit 820 may further include a continuation sinusoidal signal information calculation unit 831 that calculates the range of the continuation sinusoidal signal information according to index information of the current frame in a super frame including sub frames.

The encoding unit 830 may perform Advanced Audio Coding (AAC), MPEG-1 Audio Layer-3 (MP3), Windows Media Audio (WMA), and Bit Sliced Arithmetic Coding (BSAC).

Figure 9:
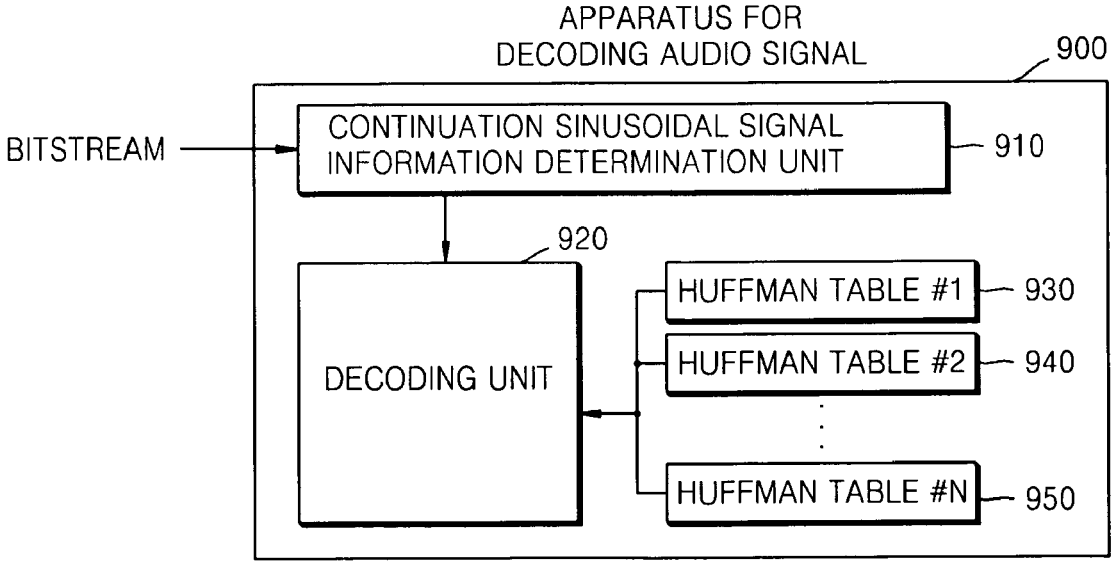
FIG. 9 is a block diagram of an apparatus for decoding an audio signal according to an exemplary embodiment of the present invention.

FIG. 9 is a block diagram of an apparatus 900 for decoding an audio signal according to an exemplary embodiment of the present invention.

Referring to FIG. 9, the apparatus 900 for decoding an audio signal input as a bitstream includes a continuation sinusoidal signal information determination unit 910 and a decoding unit 920. The continuation sinusoidal signal information determination unit 910 determines whether the input bitstream includes continuation sinusoidal signal information indicating the number of continuation sinusoidal signals of a next frame, which continue from a sinusoidal signal of a current frame. The decoding unit 920 decodes the continuation sinusoidal signal information using different Huffman tables 930 through 950 according to index information of the current frame if the bitstream includes the continuation sinusoidal signal information.

In other words, upon input of an audio signal coded into a bitstream, the continuation sinusoidal signal information determination unit 910 determines whether the current frame includes the continuation sinusoidal signal information and if so, the decoding unit 920 decodes the continuation sinusoidal signal information determination unit 910 by selecting one of the different Huffman tables according to a frame index of the current frame.

As described above, according to the exemplary embodiments of the present invention, efficient encoding can be performed with a low bitrate and a frame is composed of several sub frames and can be used to encode a bitstream in units of a frame.

The method of encoding an audio signal and the method of decoding an audio signal according to exemplary embodiments of the present invention can be written as computer programs and can be implemented in general-use digital computers that execute the programs using a computer readable recording medium.

As mentioned above, the structure of data used in the present invention can be recorded onto a computer-readable recording medium using various means.

Examples of the computer readable recording medium include magnetic storage media (e.g., ROM, floppy disks, hard disks, etc.), and optical recording media (e.g., CD-ROMs, or DVDs).

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A method of encoding an audio signal, the method comprising:

performing sinusoidal analysis on an audio signal in order to extract a sinusoidal signal of a current frame;

determining continuation sinusoidal signal information indicating a number of continuation sinusoidal signals of next frames, which continue from the sinusoidal signal of the current frame, by performing sinusoidal tracking on the extracted sinusoidal signal of the current frame; and encoding the determined continuation sinusoidal signal information by using a plurality of different Huffman tables according to index information of the current frame.

2. The method of claim 1, wherein the continuation sinusoidal signal information indicates a number of subsequent frames in which the continuation sinusoidal signals continuing from the sinusoidal signal of the current frame exist.

3. The method of claim 2, wherein the determining the continuation sinusoidal signal information comprises determining a range of the continuation sinusoidal signal information according to the index information of the current frame in a super frame including the current frame.

4. The method of claim 3, wherein the determining the range of the continuation sinusoidal signal information comprises determining the range of the continuation sinusoidal signal information in the current frame based on index information of a frame to be encoded together with the continuation sinusoidal signal information for random access in a next super frame following the super frame.

5. The method of claim 4, wherein the encoding the determined continuation sinusoidal signal information by using the plurality of different Huffman tables comprises using a Huffman table corresponding to the determined range of the continuation sinusoidal signal information of the current frame from among a plurality of Huffman tables generated according to ranges of the continuation sinusoidal signal information.

6. The method of claim 5, wherein a number of the plurality of Huffman tables is the same as a number of frames included in the super frame.

7. An apparatus for encoding an audio signal, the apparatus comprising:

a sinusoidal signal analysis unit which performs sinusoidal analysis on an audio signal in order to extract a sinusoidal signal of a current frame;

a continuation sinusoidal signal information determination unit which determines continuation sinusoidal signal information indicating a number of continuation sinusoidal signals of next frames, which continue from the sinusoidal signal of the current frame, by performing sinusoidal tracking on the extracted sinusoidal signal of the current frame;

an encoding unit which encodes the determined continuation sinusoidal signal information by using a plurality of different Huffman tables according to index information of the current frame.

8. The apparatus of claim 7, wherein the continuation sinusoidal signal information indicates a number of subsequent frames in which the continuation sinusoidal signals continuing from the sinusoidal signal of the current frame exist.

9. The apparatus of claim 8, wherein the continuation sinusoidal signal information determination unit comprises a continuation sinusoidal signal information calculation unit which determines a range of the continuation sinusoidal signal information according to the index information of the current frame in a super frame including the current frame.

10. The apparatus of claim 9, wherein the continuation sinusoidal signal information calculation unit determines the range of the continuation sinusoidal signal information in the current frame based on index information of a frame to be encoded together with the continuation sinusoidal signal information for random access in a next super frame following the super frame.

11. The apparatus of claim 10, wherein the encoding unit uses a Huffman table corresponding to the determined range of the continuation sinusoidal signal information of the current frame from among a plurality of Huffman tables generated according to ranges of continuation sinusoidal signal information.

12. The apparatus of claim 11, wherein a number of the plurality of Huffman tables is the same as a number of frames included in the super frame.

13. A method of decoding an audio signal input as a bitstream, the method comprising:

determining whether the input bitstream includes continuation sinusoidal signal information indicating a number of continuation sinusoidal signals of a next frame, which continue from a sinusoidal signal of a current frame; and decoding the continuation sinusoidal signal information by using a plurality of different Huffman tables according to index information of the current frame if it is determined that the bitstream includes the continuation sinusoidal signal information.

14. An apparatus for decoding an audio signal input as a bitstream, the apparatus comprising:

a continuation sinusoidal signal information determination unit which determines whether the input bitstream includes continuation sinusoidal signal information indicating a number of continuation sinusoidal signals of a next frame, which continue from a sinusoidal signal of a current frame; and a decoding unit decoding the continuation sinusoidal signal information by using a plurality of different Huffman tables according to index information of the current frame if the continuation sinusoidal signal information determination unit determines that the bitstream includes the continuation sinusoidal signal information.

15. A computer-readable recording medium having recorded thereon a program for executing a method of encoding an audio signal, the method comprising:

performing sinusoidal analysis on an audio signal in order to extract a sinusoidal signal of a current frame;

determining continuation sinusoidal signal information indicating a number of continuation sinusoidal signals of next frames, which continue from the sinusoidal signal of the current frame, by performing sinusoidal tracking on the extracted sinusoidal signal of the current frame; and encoding the determined continuation sinusoidal signal information by using a plurality of different Huffman tables according to index information of the current frame.

* * * * *